US005670923A

United States Patent [19]

Gonzalez et al.

[11] Patent Number: 5,670,923

[45] Date of Patent: Sep. 23, 1997

[54] TRIPPING DEVICE RESET ARRANGEMENT

[75] Inventors: Jorge Gonzalez, Carolina, Puerto Rico; Roger Castonguay, Terryville; Jeffrey Lord, Unionville, both of Conn.

[73] Assignee: General Electric Company, New York, N.Y.

[21] Appl. No.: 626,218

[22] Filed: Mar. 29, 1996

[51] Int. Cl.[6] ..... H01H 9/00

[52] U.S. Cl. ..... 335/177; 335/172

[58] Field of Search ..... 335/167–176, 335/35, 23–25, 177–179

[56] References Cited

U.S. PATENT DOCUMENTS

| | | | |
|---|---|---|---|
| 3,073,936 | 1/1963 | Baird . | |
| 3,693,122 | 9/1972 | Willard . | |
| 3,761,778 | 9/1973 | Willard . | |
| 4,672,501 | 6/1987 | Bilac et al. . | |
| 4,808,952 | 2/1989 | Berner et al. | 335/172 |
| 4,931,758 | 6/1990 | Bagalini | 335/174 |
| 5,027,093 | 6/1991 | Palmer et al. | 335/176 |

*Primary Examiner*—Lincoln Donovan

*Attorney, Agent, or Firm*—Richard A. Menelly; Carl B. Horton

[57] ABSTRACT

A field-installable circuit breaker trip unit conversion kit in the form of a flux shifter unit that interfaces with the circuit breaker operating mechanism is installable without dismantling the circuit breaker components. The flux shifter unit responds to an electronic trip unit to articulate the circuit breaker operating mechanism and separate the circuit breaker contacts upon occurrence of an overcurrent condition. Expansion springs achieve tolerance take-up for different operating mechanism assemblies to correctly interface with the associated electronic trip unit.

8 Claims, 4 Drawing Sheets

TRIPPING DEVICE RESET ARRANGEMENT

BACKGROUND OF THE INVENTION

High ampere-rated circuit breakers such as described within U.S. Pat. No. 3,073,936 entitled "Electric Circuit Interrupter" are currently employed within industrial manufacturing facilities to protect the electric equipment and buildings from damage due to overcurrent conditions within the electrical distribution system. Earlier manufactured circuit breakers employed thermal-magnetic trip units to determine overcurrent conditions and to articulate the circuit breaker operating mechanism to separate the circuit breaker contacts to interrupt the associated electric circuit. Later manufactured circuit breakers employed electronic trip units which contained so-called "flux shifters" to articulate the operating mechanism upon signal from the electronic trip unit. One example of an early electronic trip unit is found in U.S. Pat. No. 3,761,778 entitled "Static Trip Control Unit for Electric Circuit Breaker".

Such robust circuit breakers remain in operation to this date without needing replacement or repair. However, state of the art digital trip units of the type described within U.S. Pat. No. 4,672,501 entitled "Circuit Interrupter and Controller Unit", provide more reliable protection by better control over the circuit interruption time and current parameters. It would be economically advantageous to incorporate state of the art digital trip units within existing circuit breakers without having to dismantle the circuit breaker operating components in the process.

One purpose of the invention, accordingly, is to provide a conversion unit that will incorporate digital trip units within existing circuit breakers without having to dismantle the circuit breaker operating components.

SUMMARY OF THE INVENTION

In accordance with the invention, an electronic trip unit conversion kit includes a flux shifter and reset arrangement to articulate the circuit breaker operating mechanism upon the occurrence of an overcurrent condition to separate the circuit breaker contacts and to reset the flux shifter after the circuit breaker contacts have become separated.

DESCRIPTION OF THE PREFERRED EMBODIMENT

Figure 1:
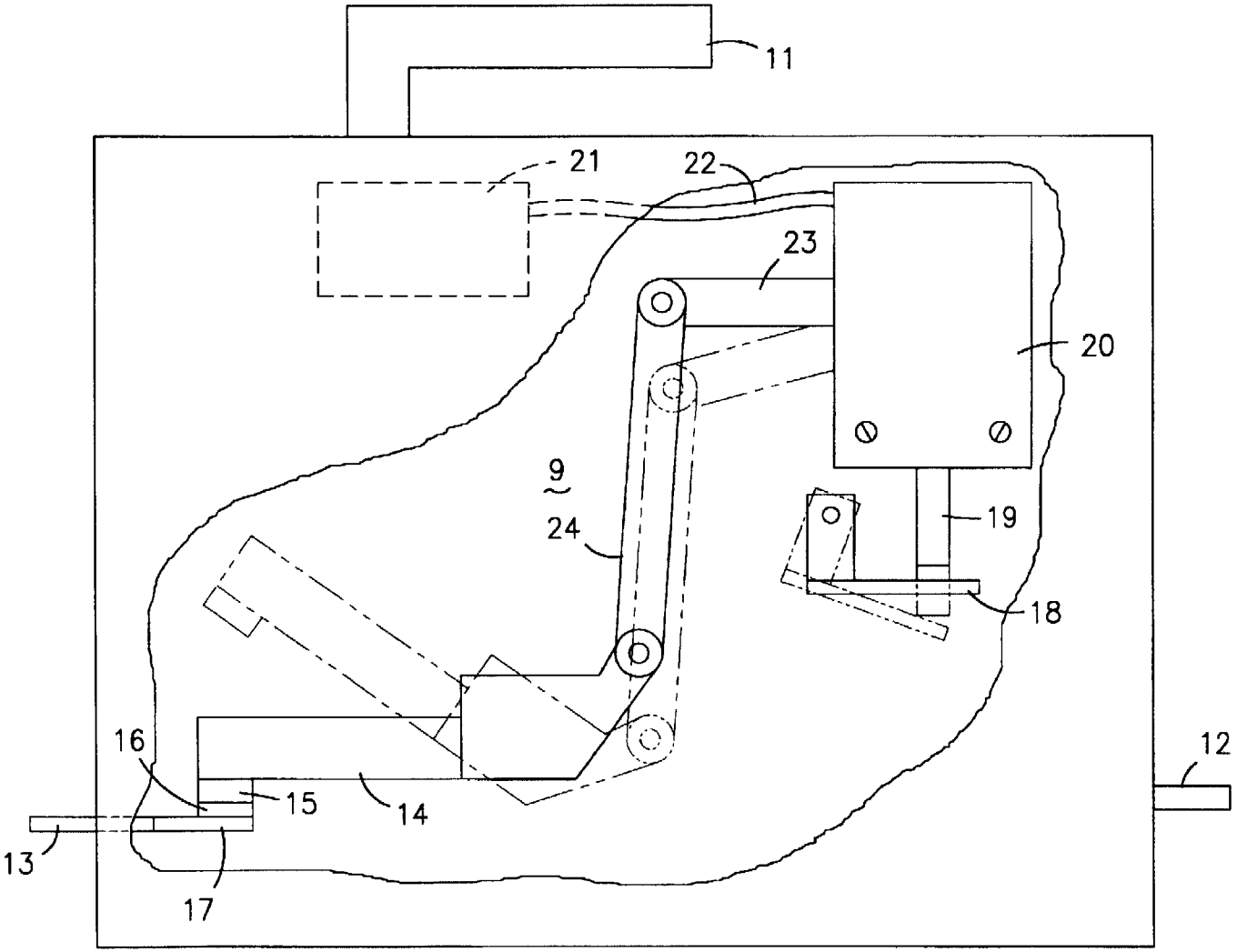
FIG. 1 is a side view of a circuit breaker with a part of the case removed to depict the circuit breaker contact arms, contacts and associated trip actuator in accordance with the invention.

FIG. 1 shows an industrial-rated circuit breaker 10, such as described in aforementioned U.S. Pat. No. 3,073,936, with an operating handle 11 extending from the top with load straps 12 and line straps 13 arranged at opposite ends thereof. The movable contacts 15 at one end of the movable contact arm 14 and the fixed contacts 16 on the contact support 17 are shown in solid lines in the CLOSED condition and in phantom lines in the OPEN condition. As described in the aforementioned U.S. Pat. No. 3,073,936, the condition of the contacts are controlled by an operating mechanism (not shown) that is refrained from articulation by means of a trip latch 18. In accordance with the invention, a trip unit conversion kit 9 includes a programmer or electronic trip unit 21, such as described in aforementioned U.S. Pat. No. 4,672,501, that connects with a trip actuator unit 20 by means of a wire conductor 22. Upon receipt of a trip signal from the trip unit, the trip actuator releases a trip plunger 19 which strikes the trip latch 18 allowing the operating mechanism to separate the contacts 15, 16 as described in the aforementioned U.S. Pat. No. 3,073,936. The connector link 24 is attached to the reset arm 23 to return the trip plunger 19 from the actuated position to the to the reset position. As will be discussed below, the motion of the movable contact arm 14 upon separation of the contacts 15, 16 returns the trip actuator to the reset position by connection with the connector link 24 and the reset arm 23.

Figure 2:
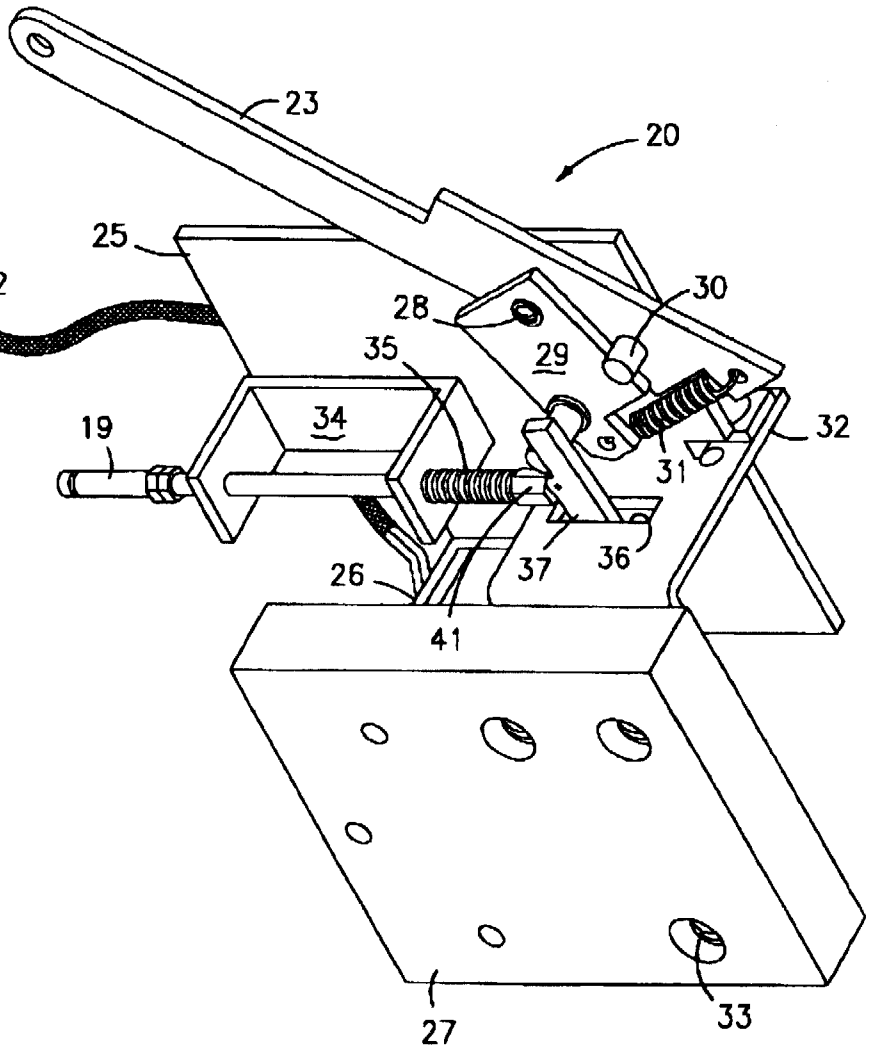
FIG. 2 is a top perspective view of the trip actuator of FIG. 1.
Figure 3:
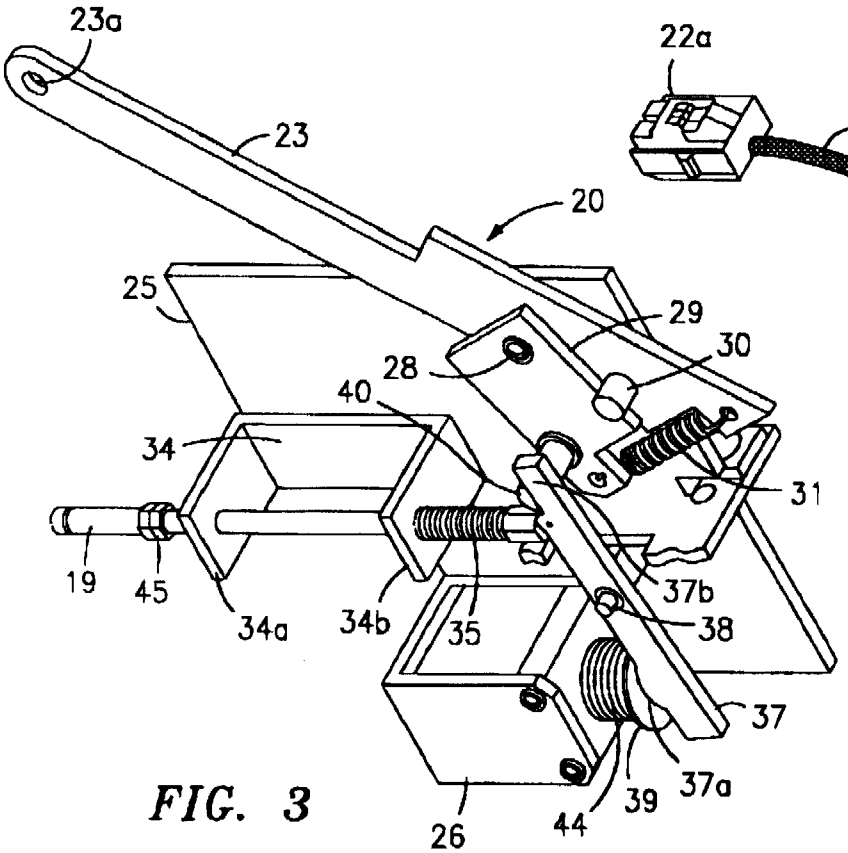
FIG. 3 is a top perspective view of the trip actuator of FIG. 2 with the front mounting plate removed.

The trip actuator as shown in FIGS. 2 and 3 is supported between a front mounting plate 27 and a rear mounting plate 25. The support bracket 32 attached to the front plate 27 by means of screws 33 guides the movement of the intermediate lever 37 that extends through the slot 36 formed in the support bracket. The reset arm 23 is trapped between the rear plate 25 and the reset plate 29 by means of the pivot pin 28. The bottom of the reset arm 23 is connected to the bottom of the reset plate 29 by means of the take-up spring 31 which provides automatic tolerance connection with the opposite end of the reset arm when the trip actuator is used within circuit breakers of different manufacture. The flux shifter unit 26 is similar to that described within U.S. Pat. No. 3,693,122 entitled "Flux Transfer Device" that releases a flux shifter plunger 39 upon receipt of a voltage pulse to counteract the magnetic holding force on the plunger and allow the plunger to extend under the urgence of the charged compression spring 44. The voltage pulse is supplied to the flux shifter 26 over the wire conductor 22 that connects with the trip unit 21 of FIG. 1 by means of the plug connector 22A. The trip plunger 19 passes through the U-shaped take-up bracket 34 and connects with the top part of the intermediate lever 37. The bias spring 35 interfaces between the exterior of the bracket 34 and the end cap 41 that holds the spring to the trip plunger and connects the end of the plunger to the intermediate lever 37. The bias spring 35, along with the adjustment nuts 45, provide tolerance take-up facility to the trip plunger to insure good interaction with the trip latch 18 of FIG. 1. As best seen in FIG. 3, with the front plate 27 removed, the bottom of the intermediate lever 37 contacts the end of the flux shift plunger 39 as indicated at 37A when the top of the intermediate lever abuts the reset pin 40, as indicated at 37B. In the reset position of the flux shifter 26, the compression spring 44 is charged and the reset plate 29 abuts the stop pin 30 extending from the reset arm 23. The arrangement of the stop pin 30 against the reset plate 29 allows the reset plate to move in unison with the reset arm when the reset arm is rotated in the clockwise direction while allowing the reset arm to move independently from the reset plate 29 when the reset arm is rotated in the counter-clockwise direction and the reset pin 40 is bottomed against the top of the intermediate lever 37 as indicated at 37B. The over-travel of the of the reset arm 23 in the counterclockwise direction is controlled by the expansion of the take-up spring 31 to allow for differences between the various movable contact arms that may be connected with the reset lever 23 by means of the connector link 24 shown in FIG. 4. The thru-hole 23A formed in the opposite end of the reset arm 23 allows the reset arm to become attached to the connector link 24 extending from the circuit breaker movable contact arm 14 shown earlier in FIG. 1.

Figure 4:
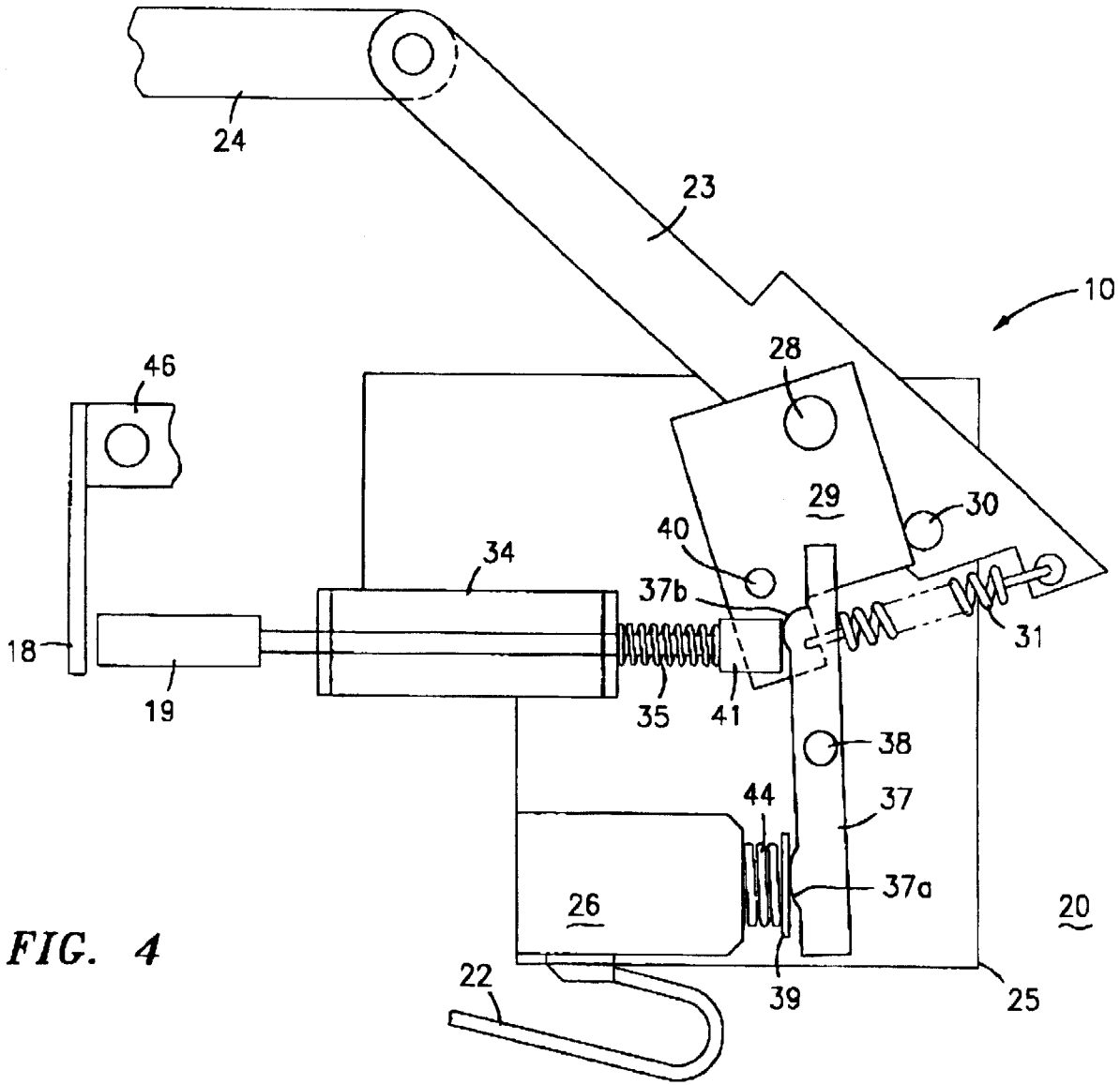
FIG. 4 is an enlarged side view of the trip actuator of FIG. 3 in a reset condition.
Figure 5:
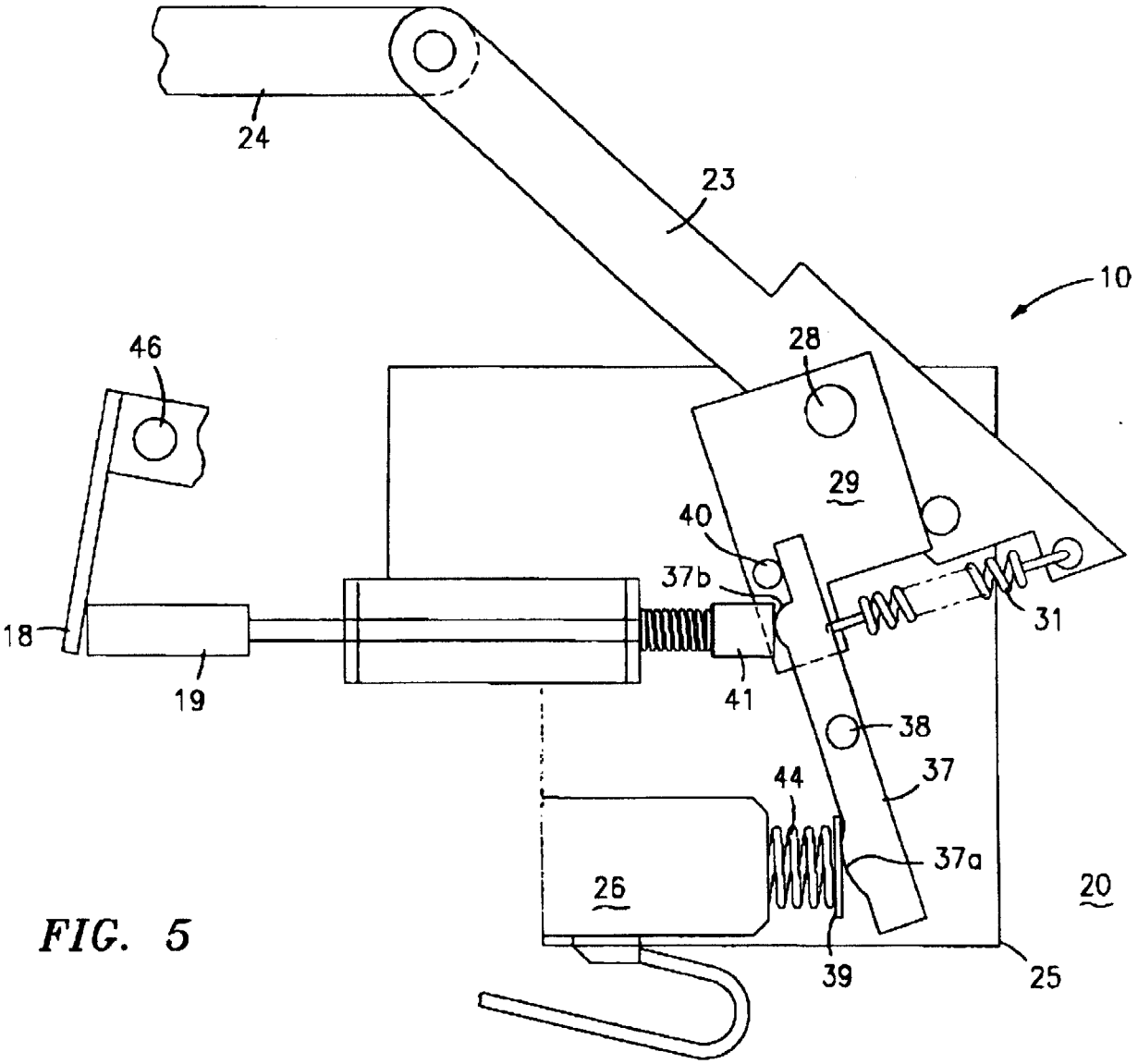
FIG. 5 is an enlarged side view of the trip actuator of FIG. 3 in a tripped condition.

The reset position of the flux shifter 26 is best seen by referring to the trip actuator 20 depicted in FIG. 4. The reset arm 23 is attached to the end of the connector link 24, and the edge of the reset plate 29 abuts against the stop pin 30. The bottom 37A of the intermediate lever 37 abuts against the flux shifter plunger 39 with the compression spring 44 fully charged and with the top against the extruded bias spring 35. The end of the trip plunger 19 is out of contact with the circuit breaker trip latch 18 and the bias spring 35 on the opposite end of the trip plunger is extended. Upon receipt of a trip signal to the flux shifter over conductor 22, the flux shifter plunger 39, as shown in FIG. 5, extends under the urgence of the compression spring 44 against the bottom 37A and drives the intermediate lever 37 into counter-clockwise rotation about the pivot 38 striking the top 37B against the end cap 41 forcing the trip plunger 19 against the trip latch 18 rotating the trip latch 18 about the latch pivot 46 to articulate the operating mechanism (not shown) and separate the circuit breaker contacts 15, 16 of FIG. 1. In the process of separating the contacts, the movable contact arm 14 drives the connector link 24 and the attached reset arm 23 to the positions indicated in phantom rotating the reset arm 23 counter-clockwise about the pivot pin 28, to extend the take-up spring 31 which rotates the reset plate 29 counter-clockwise and moves the reset pin 40 on the reset plate into contact with the top 37B of the intermediate lever 37 as described earlier. The top end of the intermediate lever 37 then rotates clockwise about the pivot 38 and drives the bottom end 37A of the intermediate lever 37 against the flux shift plunger 39 driving the plunger to its reset position, shown in FIG. 4, to charge the compression spring 44. The connection between the reset arm 23 and the reset plate 29 by means of the take-up spring 31 is an important feature of the invention in view of the automatic tolerance adjustment for the different movable contact arms, as described earlier.

We claim:

1. A trip unit conversion kit for circuit breakers comprising:

electronic means for providing a trip initiating signal to a circuit breaker;

tripping means responsive to said trip initiating signal to articulate a circuit breaker operating mechanism and separate a pair of circuit breaker contacts, said tripping means including a flux transfer device having a flux transfer plunger;

a trip plunger arranged for displacing a circuit breaker latch upon interaction with said flux transfer plunger;

an intermediate lever pivotally arranged between said flux transfer plunger and said trip plunger; and a reset plate pivotally connected to a reset arm for interaction with said intermediate lever, one end of said reset arm connects with said reset plate by means of an expansion spring, said reset plate includes a reset pin and said reset arm includes a stop pin, one end of said intermediate lever interacting with said reset pin and one edge of said reset plate interacting with said stop pin.

2. The trip unit conversion kit of claim 1 wherein said trip plunger includes an end cap at one end and a bias spring, said end cap interacting with said intermediate lever to drive said trip plunger into contact with a trip latch.

3. The trip unit conversion kit of claim 2 further including a take-up bracket, said bias spring arranged intermediate one end of said take-up bracket and said end cap.

4. The trip unit conversion kit of claim 1 wherein said flux transfer device further includes a compression spring for driving said flux transfer plunger into contact with said intermediate lever.

5. A circuit breaker comprising:

an enclosure;

an operating mechanism within said enclosure for separating a pair of contacts upon command;

a line strap on one end of said enclosure for connecting said contacts with an electrical source;

a line strap on an opposite end of said enclosure for connecting said contacts with electrical equipment;

an operating handle extending from said enclosure for manual control of said operating mechanism;

electronic means for providing a trip initiating signal to a circuit breaker;

tripping means responsive to said trip initiating signal to articulate said operating mechanism and separate said circuit breaker contacts, said tripping means including a flux transfer device having a flux transfer plunger;

a circuit breaker latch restraining said operating mechanism and a trip plunger arranged for displacing said latch upon interaction with said flux transfer plunger;

an intermediate lever pivotally connecting between said flux transfer plunger and said trip plunger; and a reset plate pivotally connected to a reset arm for interaction with said intermediate lever, one end of said reset arm connects with one end of said reset plate by means of an expansion spring and an opposite end of said reset arm connects with a circuit breaker movable contact arm supporting one of said separable contacts said reset plate includes a reset pin and said reset arm includes a stop pin, one end of said intermediate lever interacting with said reset pin and one edge of said reset plate interacting with said stop pin.

6. The circuit breaker of claim 5 wherein said trip plunger includes an end cap at one end and a bias spring, said end cap interacting with said intermediate lever to drive said trip plunger into contact with a trip latch.

7. The circuit breaker of claim 6 including a take-up bracket, said bias spring arranged intermediate one end of said take-up bracket and said end cap.

8. The circuit breaker of claim 7 wherein said flux transfer device further includes a compression spring for driving said transfer plunger into contact with said intermediate lever.

* * * * *